US009249762B2

(12) United States Patent
Yamamoto

(10) Patent No.: US 9,249,762 B2
(45) Date of Patent: Feb. 2, 2016

(54) EVAPORATED FUEL TREATMENT APPARATUS

(71) Applicant: Aisan Kogyo Kabushiki Kaisha, Obu-shi, Aichi-ken (JP)

(72) Inventor: Norihisa Yamamoto, Aichi (JP)

(73) Assignee: Aisan Kogyo Kabushiki Kaisha (JP)

( * ) Notice: Subject to any disclaimer, the term of this patent is extended or adjusted under 35 U.S.C. 154(b) by 279 days.

(21) Appl. No.: 13/900,663

(22) Filed: May 23, 2013

(65) Prior Publication Data

US 2013/0312712 A1 Nov. 28, 2013

(30) Foreign Application Priority Data

May 24, 2012 (JP) ..... 2012-118802

(51) Int. Cl.
*F02M 33/02* (2006.01)
*F02M 25/08* (2006.01)

(52) U.S. Cl.
CPC ..... *F02M 25/0854* (2013.01)

(58) Field of Classification Search
CPC ..... B60K 15/03504; B01D 46/0005; B01D 2201/00; B01D 2201/02
USPC ..... 123/519–520
See application file for complete search history.

(56) References Cited

U.S. PATENT DOCUMENTS 4,403,587 A * 9/1983 Mizuno et al. ..... 96/144
4,448,594 A * 5/1984 Kozawa ..... 96/130
6,524,374 B2 2/2003 Moriyama et al.

FOREIGN PATENT DOCUMENTS

JP 6-53748 U 7/1994
JP 2001-323845 A 11/2001
JP 2007-192052 A 8/2007

OTHER PUBLICATIONS

Office Action mailed on Jun. 23, 2015 in corresponding Japanese patent application No. 2012-118802.
English translation of the Office Action mailed on Jun. 23, 2015 in corresponding Japanese patent application No. 2012-118802.
Microfilm of Utility Model Application No. 62-61674 (JP-U-63-168257).

* cited by examiner

*Primary Examiner* — Hung Q Nguyen

(74) *Attorney, Agent, or Firm* — Wood, Phillips, Katz, Clark & Mortimer

(57) ABSTRACT

In an evaporated fuel treatment apparatus mounted laterally, in order to effectively utilize adsorbent of an upper portion in an adsorption chamber of the evaporated fuel treatment apparatus, the evaporated fuel treatment apparatus comprises: one or more adsorption chambers filled with the adsorbent that adsorbs and desorbs evaporated fuel generated in a fuel tank; a tank port; a purge port; and an atmosphere port, and in the evaporated fuel treatment apparatus, a first filter is provided in a boundary portion between the adsorption chamber located closest to the tank port and the tank port, and an amount of gas, having flowed in the adsorption chamber from the tank port, passing through an upper portion of the first filter is made larger than that of the gas passing through a lower portion thereof.

6 Claims, 5 Drawing Sheets

EVAPORATED FUEL TREATMENT APPARATUS

BACKGROUND OF THE INVENTION (1) Field of the Invention

The present invention relates to an evaporated fuel treatment apparatus, (2) Description of Related Art Conventionally, in order to prevent evaporated fuel from being released to the atmosphere from a fuel tank of an automobile, etc., there has been used such a method that evaporated fuel generated in the fuel tank, etc. is made to flow into an evaporated fuel treatment apparatus (hereinafter referred to as a canister) provided with an adsorption chamber filled with activated carbon adsorbing and desorbing the evaporated fuel, so as to temporarily adsorb the evaporated fuel to the activated carbon (see, for example, JP-A-2001-323845).

In the conventional canister, a filter provided in a boundary portion between a tank port and an adsorption chamber provided closest to the tank port is formed entirely to have a same thickness, and is arranged so as to be substantially perpendicular to an axis line of the tank port.

Therefore, when the conventional canister is laterally mounted in a vehicle, there has been a problem that since an air-flow resistance of the filter directly under the tank port is substantially constant from an upper portion to a lower portion thereof, and evaporated fuel generated in the fuel tank is heavier than the air, in an adsorption chamber, the evaporated fuel is adsorbed to activated carbon located on the lower portion, and activated carbon located on the upper side is hard to be used.

BRIEF SUMMARY OF THE INVENTION

Consequently, an object of the present invention is to provide an evaporated fuel treatment apparatus in which an adsorbent of an upper portion in an adsorption chamber can also be effectively utilized.

In order to achieve the above-described object, according to the present invention, there is provided an evaporated fuel treatment apparatus that comprises: one or more adsorption chambers filled with adsorbent that adsorbs and desorbs evaporated fuel generated in a fuel tank; a tank port; a purge port; and an atmosphere port, and that is laterally mounted so that the evaporated fuel moves in a lateral direction in the adsorption chambers, and the evaporated fuel treatment apparatus is characterized in that a first filter is provided in a boundary portion between the adsorption chamber located closest to the tank port and the tank port, and an amount of gas, which has flowed into the adsorption chamber from the tank port, passing through an upper portion of the first filter is larger than that of the gas passing through a lower portion thereof.

In the present invention, an air-flow resistance of the upper portion of the first filter may be made smaller than that of the lower portion thereof, so as to make the amount of the gas, which has flowed from the tank port, passing through the upper portion of the first filter larger than that of the gas passing through the lower portion thereof.

In the present invention, a thickness of the first filter may be formed so as to be thinner continuously or in stages from a lower end to an upper end.

In the present invention, an end surface of the first filter on a tank port side may be formed to be inclined so that a lower end of the end surface is located closer to the tank port side than an upper end thereof.

In the present invention, a restriction portion whose opening area per unit area of an upper portion is larger than that of a lower portion may be provided on the tank port side of the first filter.

In the present invention, a second filter may be provided to be inclined at an end on the atmosphere port side of the adsorption chamber located closest to the atmosphere port so that a lower end of the second filter is located closer to the tank port than an upper end thereof.

According to the present invention, the amount of gas, which has flowed from the tank port, passing through the upper portion of the first filter is made larger than that of the gas passing through the lower portion thereof, and thereby adsorbent located upwardly in the adsorption chamber, which is hard to be used for adsorbing evaporated fuel in a conventional canister, can be used effectively.

DETAILED DESCRIPTION OF THE INVENTION

Modes for carrying out the present invention will be described based on drawings.

Embodiment 1

FIGS. 1 to 4 show Embodiment 1 according to the present invention.

Figure 1:
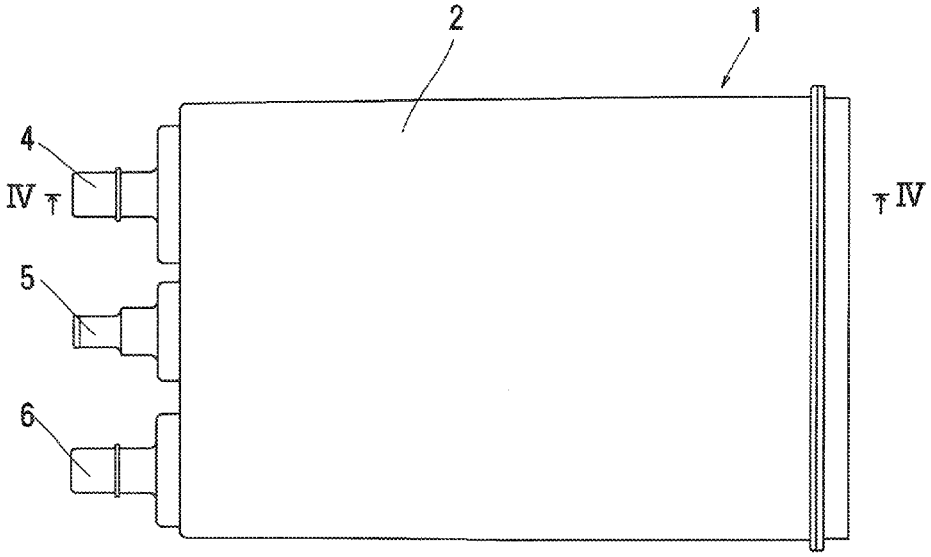
FIG. 1 is a bottom view of an evaporated fuel treatment apparatus according to Embodiment 1 of the present invention.
Figure 2:
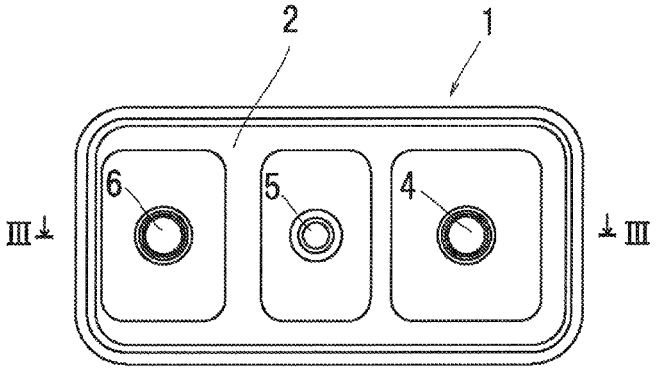
FIG. 2 is a left side view of the evaporated fuel treatment apparatus of FIG. 1.
Figure 3:
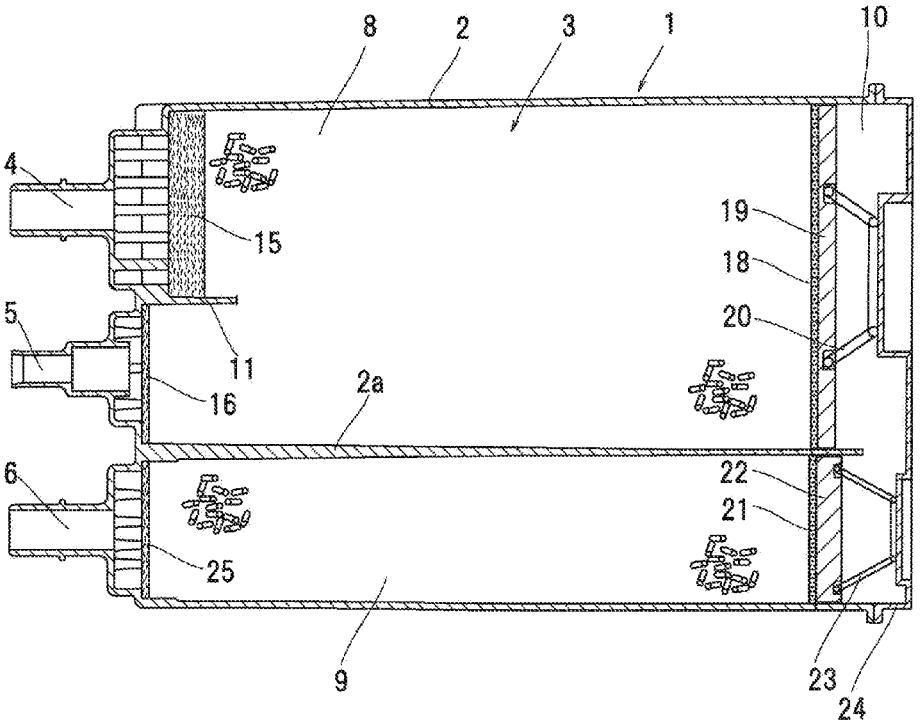
FIG. 3 is a cross-sectional view taken along a line of FIG. 2.
Figure 4:
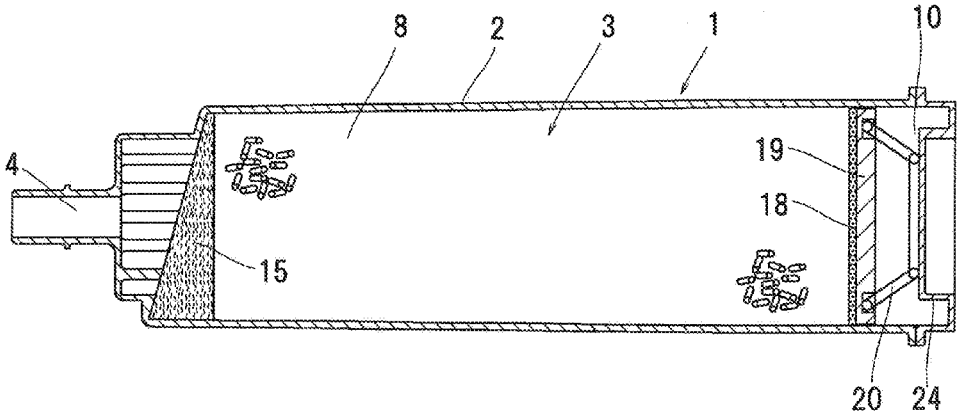
FIG. 4 is a cross-sectional view taken along a line IV-IV of FIG. 1.

FIG. 1 shows a bottom view of an evaporated fuel treatment apparatus 1, FIG. 2 a left side view of the evaporated fuel treatment apparatus in FIG. 1, FIG. 3 a cross-sectional view taken along a line III-III in FIG. 2, and FIG. 4 a cross-sectional view taken along a line IV-IV FIG. 1. The evaporated fuel treatment apparatus 1 is the apparatus that is used to be laterally mounted in an automobile etc. so that a horizontal direction of FIG. 4 corresponds to a lateral direction, and in which gas, such as evaporated fuel, moves in the lateral direction in adsorption chambers 8 and 9 that will be described later. Hereinafter, Embodiment 1 will be described assuming that the horizontal direction of FIG. 4 corresponds to the lateral direction, and that a direction from a top to a bottom thereof corresponds to a vertical direction.

The evaporated fuel treatment apparatus 1 of the present invention, as shown in FIGS. 1 to 4, has a case 2, a passage 3 through which a fluid can flow is formed inside the case 2, a tank port 4 and a purge port 5 are formed at an end of one end side of the passage 3 in the case 2, and an atmosphere port 6 is formed at an end of the other end side thereof.

The tank port 4 is communicated with an upper air chamber of a fuel tank through a valve that is not shown, and the purge port 5 is connected to an intake passage of an engine through a purge control valve (VSV) and a purge passage which are not shown. A divergence angle of the purge control valve is controlled by an ECU (electronic control unit), and purge control is performed during engine operation. The atmosphere port 6 is communicated with an outside through a passage that is not shown.

A plurality of adsorption chambers filled with an adsorbent that adsorbs and desorbs evaporated fuel generated in the fuel tank are provided in the passage 3 from the tank port 4 side to the atmosphere port 6 side as the first adsorption chamber 8 and the second adsorption chamber 9 in that order. In the embodiment, activated carbon with a predetermined average particle size is used as adsorbent. It is to be noted that granulated activated carbon may be used as activated carbon.

As shown in FIG. 3, a partition wall 2*a* is provided in the case 2 to partition the case 2 into the first adsorption chamber 8 and the second adsorption chamber 9, the first adsorption chamber 8 and the second adsorption chamber 9 are communicated with each other by a space 10 formed in the case 2 on an opposite side of the tank port 4 side, and gas turns around in the space 10 to flow in a substantially U-shaped manner, when flowing from the tank port 4 to the atmosphere port 6.

Between the tank port 4 and the purge ports 5 in the case 2 is provided a baffle plate 11 that extends from an internal surface in the case 2 to a part of the first adsorption chamber 8. By the baffle plate 11, fluid flowing between the tank port 4 and the purge port 5 flows through the first adsorption chamber 8.

A first filter 15 formed of nonwoven fabric, urethane, etc. is provided in a boundary portion between the tank port 4 and an end (one end) of the first adsorption chamber 8 on the tank port 4 side, and additionally, a filter 16 formed of nonwoven fabric, urethane, etc. is provided in a boundary portion between the purge port 5 and the end thereof.

In addition, on a surface of the first adsorption chamber 8 on the space 10 side is provided a filter 18 formed of urethane etc. that covers the whole surface thereof, and on a space 10 side of the filter 18 is provided a plate 19 having a number of communication holes. The plate 19 is biased to the tank port 4 side by biasing means 20, such as a spring.

On a surface of the second adsorption chamber 9 on the space 10 side is provided a filter 21 formed of urethane etc. that covers the whole. On the space 10 side of the filter 21 is provided a plate 22 in which a number of communication holes are provided substantially equally in a whole surface. The plate 22 is biased to the atmosphere port 6 side by biasing members 23, such as a spring.

The space 10 is formed between the plates 19 and 22 and a cover plate 24 of the case 2, and the first adsorption chamber 8 and the second adsorption chamber 9 are communicated with each other by the space 10.

On the atmosphere port 6 side of the second adsorption chamber 9 is provided a second filter 25 formed of nonwoven fabric, urethane, etc. that covers the whole.

The first filter 15 is, as shown in FIG. 4, formed continuously thinner toward an upper end from a lower end thereof. A surface of the first filter 15 on the tank port 4 side inclines so that a lower end thereof is located closer to the tank port 4 side than an upper end thereof, and a surface of the first filter 15 on the space 10 side is formed so as to be substantially vertical. With this structure, an air-flow resistance of the first filter 15 becomes smaller toward an upper portion from a lower portion thereof, the air containing the evaporated fuel flowed in from the tank port 4 becomes easy to pass through the upper portion than the lower portion of the first filter 15, and an amount of the air passing through the upper portion also becomes larger than that of the air passing through the lower portion of the first filter 15.

Therefore, although evaporated fuel is heavier than the air, the evaporated fuel becomes easier to pass through the upper portion of the first filter 15 than in a conventional canister, the evaporated fuel is adsorbed also to the activated carbon that is adsorbent located at the upper portion of the first adsorption chamber 8, and the adsorbent of the upper portion in the first adsorption chamber 8, particularly, the adsorbent of the upper portion of the first adsorption chamber 8 on the tank port 4 side, which cannot easily come into contact with the evaporated fuel in the conventional canister, can be used effectively.

Embodiment 2

Although the first filter 15 of Embodiment 1 is formed so that the surface thereof on the tank port 4 side is inclined and the surface thereof on the space 10 side is substantially vertical, the first filter can have an arbitrary shape if formed continuously thinner from the lower end toward the upper end thereof.

Figure 5:
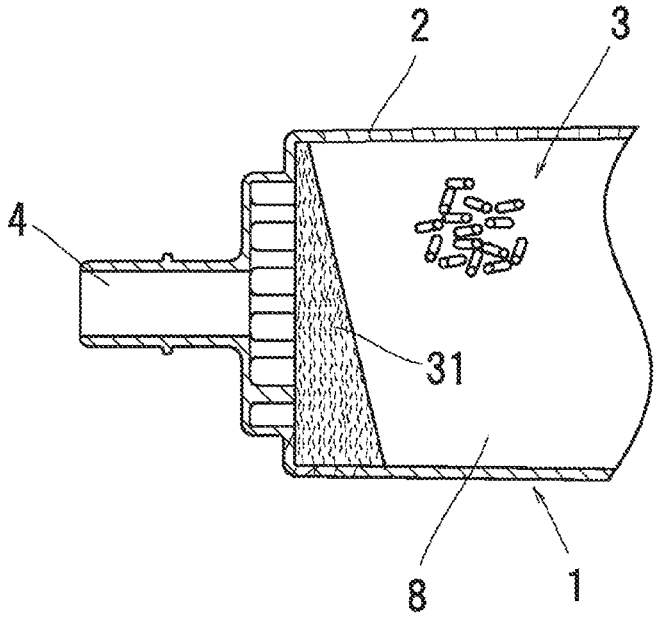
FIG. 5 is a partial cross-sectional view in Embodiment 2 according to the present invention, the cross-sectional view being corresponding to a partially enlarged view of FIG. 4 in Embodiment 1.

For example, as shown in FIG. 5, a surface of a first filter 31 on the space 10 side is formed to be inclined so that a lower end of the surface is located closer to the space 10 side than an upper end thereof, and a surface of the first filter 31 on the tank port 4 side is formed substantially vertical, whereby the first filter 31 may be formed so as to be continuously thinner from a lower end toward an upper end thereof.

It is to be noted that if the first filters 15 and 31 are formed continuously thinner from the lower ends toward the upper ends thereof, they each may be configured by one filter or may be configured by a plurality of filters.

The other structures are similar to those of Embodiment 1.

Embodiment 2 can achieve the effect similar to that in Embodiment 1.

Embodiment 3

Although in Embodiments 1 and 2, the first filters 15 and 31 are formed continuously thinner from the lower ends toward the upper ends thereof, a first filter may be formed so as to be thinner in stages from a lower end toward an upper end thereof.

Figure 6:
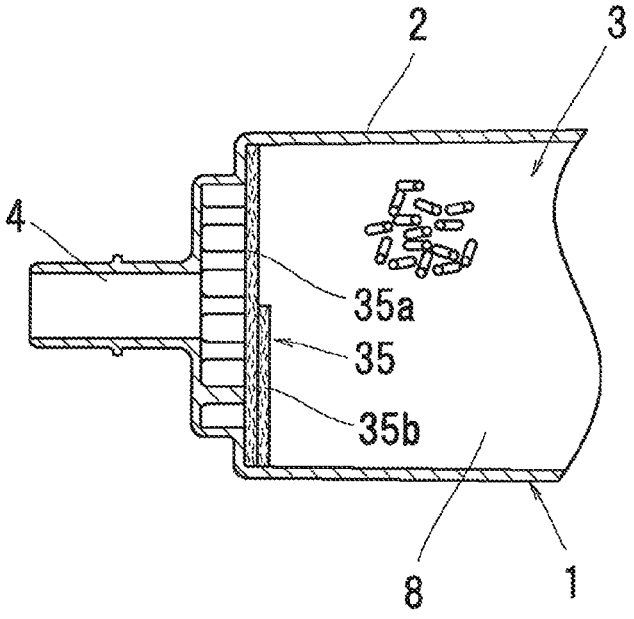
FIG. 6 is a partial cross-sectional view in Embodiment 3 according to the present invention, the cross-sectional view being corresponding to a partially enlarged view of FIG. 4 of Embodiment 1.

For example, as shown in FIG. 6, a first filter 35 is configured by two plate-like filters 35*a* and 35*b* having a substantially same thickness as a whole, the filter 35*a* is provided over a whole boundary portion between the tank port 4 and one end of the first adsorption chamber 8, and the filter 35*b* is provided to overlap a lower portion of the filter 35*a*, whereby the first filter 35 is formed thinner in stages from a lower end toward an upper end thereof, and may be configured so that the air-flow resistance of the upper portion of the first filter 35 becomes smaller than that of the lower portion thereof.

It is to be noted that if the first filter 35 is formed thinner in stages from the lower end toward the upper end thereof, the number of plate-like filters can be arbitrarily set, which have the same thickness and are to be overlapped.

In addition, the first filter 35 may be configured by one filter, so as to be formed thinner in stages from the lower end toward the upper end thereof, whereby the air-flow resistance of the upper portion of the first filter 35 becomes smaller than that of the lower portion thereof.

It is to be noted that if the first filter 35 is formed thinner in stages from the lower end toward the upper end thereof, an installation state thereof is arbitrary, and that in addition to the configuration to provide the first filter 35 substantially vertical as shown in FIG. 6, the first filter 35 may have the following configurations: the first filter 35 is inclined so that a lower end thereof is located closer to the tank port 4 than an upper end thereof; it is provided to be curved so that a center portion is located closer to the tank port 4 or the space 10 than the upper and lower ends; it is provided to be V-shaped so that the center portion is located closer to the tank port 4 or the space 10 than the upper and lower ends; etc.

The other structures are similar to those of Embodiments 1 and 2.

Also in Embodiment 3, it is configured such that the air-flow resistance of the upper portion of the first filter is smaller than that of the lower portion thereof, whereby the air containing the evaporated fuel flowed in from the tank port 4 becomes easy to pass through the upper portion than the lower portion of the first filter, an amount of the air passing through the upper portion also becomes larger than that of the air passing through the lower portion of the first filter, and Embodiment 3 achieves an effect similar to Embodiments 1 and 2.

Embodiment 4

Figure 7:
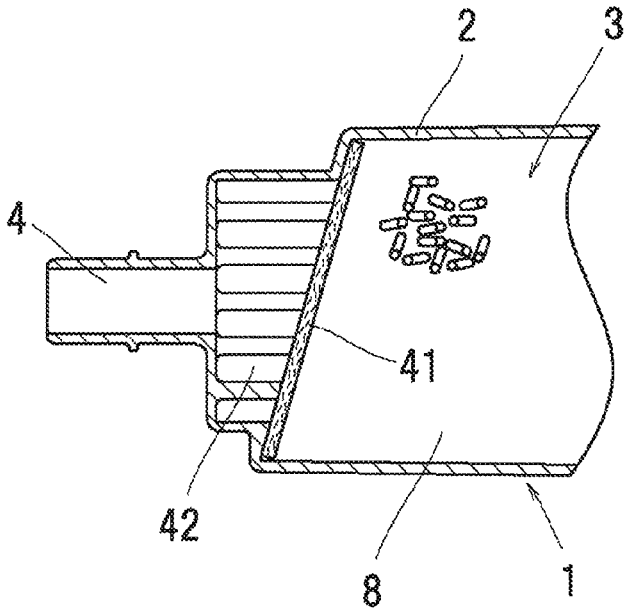
FIG. 7 is a partial cross-sectional view in Embodiment 4 according to the present invention, the cross-sectional view being corresponding to a partially enlarged view of FIG. 4 of Embodiment 1.

FIG. 7 shows Embodiment 4 according to the present invention.

Embodiment 4 of the present invention is a modified example of the first filters 15, 31 and 35 of Embodiments 1 to 3.

A first filter 41 is, as shown in FIG. 7, formed to have a same thickness from a lower end and to an upper end thereof, and is provided to be inclined so that a lower end is located closer to the tank port 4 than an upper end, and a space 42 between the first filter 41 and the tank port 4 is formed to have an upper portion larger than a lower portion.

With this structure, the air (gas) containing the evaporated fuel etc. flowed in from the tank port 4 becomes easier to pass through the upper portion than the lower portion of the first filter 41, and an amount of the air passing through the upper portion also becomes larger than that of the air passing through the lower portion of the first filter 41.

The other structures are similar to those of Embodiments 1 to 3.

Also in Embodiment 4, the air (gas) containing the evaporated fuel etc. flowed in from the tank port 4 becomes easier to pass through the upper portion than the lower portion of the first filter 41, the amount of the air passing through the upper portion also becomes larger than that of the air passing through the lower portion of the first filter 41, and Embodiment 4 achieves an effect similar to Embodiments 1 to 3.

Furthermore, since in Embodiment 4, the first filter 41 is configured to have a same thickness flora the upper end to the lower end, and is also provided to be inclined, a surfaces area of the first filter 41 can be made larger than that of the conventional canister, and thus, an air-flow resistance of the whole first filter 41 is reduced, and oil supply performance can be improved.

It is to be noted that a second filter 25 provided in the second adsorption chamber 9 located closest to the atmosphere port 6 on the atmosphere port 6 side is configured to have a same thickness from an upper end to a lower end and is also provided to be inclined, similarly to the first filter 41, whereby an air-flow resistance of the whole second filter 25 can also be reduced, a resistance in gas passing through the evaporated fuel treatment apparatus 1 at the time of oil supply is further reduced, and oil supply performance can be further improved.

Embodiment 5

Figure 8:
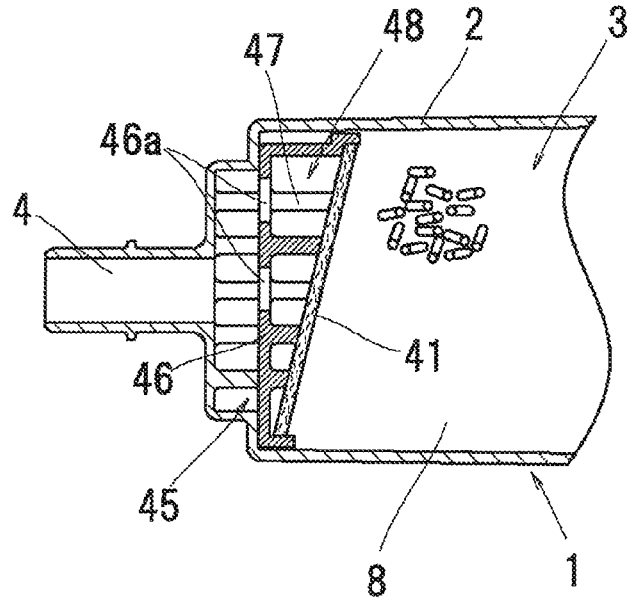
FIG. 8 is a partial cross-sectional view in Embodiment 5 according to the present invention, the cross-sectional view being corresponding to a partially enlarged view of FIG. 4 of Embodiment 1.

Embodiment 5 is the one in which a restriction portion 45 is provided on the first filters 15, 31, 35 and 41 on the tank port 4 side in Embodiments 1 to 4, and Embodiment 5 is shown in FIG. 8 as one example applied to Embodiment 4.

As shown in FIG. 8, the restriction portion 45 has a plate-like member 46 provided substantially vertical, and a plurality of through holes 46*a* are formed in the plate-like member 46. A space formation member 47 projecting to the first filter 15, 31, 35 or 41 side is formed at the plate-like member 46. A space 48 is formed between the first filter 15, 31, 35 or 41 and the plate-like member 46 by the space formation member 47.

An opening area per unit area of an upper portion of the plate-like member 46 is set to be larger than that of a lower portion thereof. In the embodiment, the through holes 46*a* are provided only in the upper portion. In addition, a total opening area of the through holes 46*a* is set to be larger than the opening area of the tank port 4.

With this structure, the air containing the evaporated fuel flowed in from the tank port 4, as compared with Embodiments 1 to 4, becomes much more easier to flow in the upper portion than in the lower portion of the first filters 15, 31, 35, 41, and an amount of the air passing through the upper portion also becomes larger than that of the air passing through the lower portion of the first filters 15, 31, 35, 41.

Embodiment 5 also achieves an effect similar to Embodiments 1 to 4.

In Embodiment 5, the restriction portion 45 is further provided, and thereby the adsorbent in the first adsorption chamber on the upper side can be used more effectively as compared with Embodiments 1 to 4.

Other Embodiments

If the evaporated fuel treatment apparatus 1 is laterally mounted in an automobile etc., and the first filters 15, 31, 35, 41 are configured as in Embodiments 1 to 5, a whole shape, the other structures, and the number and arrangement of the adsorption chambers of the evaporated fuel treatment apparatus 1 can be set arbitrarily.

Figure 9:
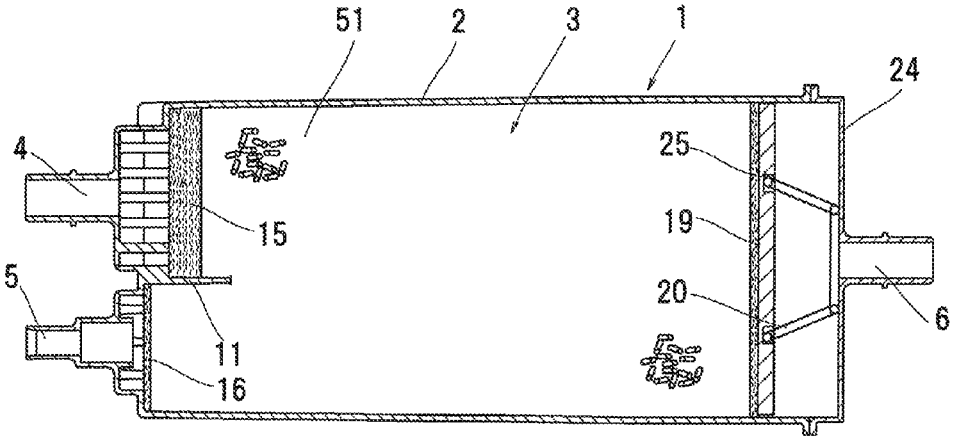
FIG. 9 is a cross-sectional view of an evaporated fuel treatment apparatus according to an other embodiment of the present invention.

For example, as shown in FIG. 9, the present invention may be applied to an evaporated fuel treatment apparatus that is configured by only one adsorption chamber 51, in which the tank port 4 and the purge port 5 are provided on one end of the adsorption chamber 51, and in which the atmosphere port 6 is provided on the other end.

The invention claimed is:

1. An evaporated fuel treatment apparatus comprising:

at least one adsorption chamber filled with adsorbent that adsorbs and desorbs evaporated fuel generated in a fuel tank; a tank port; a purge port; and an atmosphere port, said evaporated fuel treatment apparatus being laterally mounted so that the evaporated fuel moves in a lateral direction in said adsorption chamber, wherein a first filter is provided in a boundary portion between the adsorption chamber located closest to the tank port and said tank port, wherein an air-flow resistance of an upper portion of said first filter is made smaller than that of a lower portion thereof, whereby an amount of the gas, having flowed in the adsorption chamber from the tank port, passing through the upper portion of the first filter, is larger than that of the gas passing through the lower portion thereof.

2. The evaporated fuel treatment apparatus according to claim 1, wherein a thickness of said first filter is made to be continuously thinner from a lower end to an upper end thereof.

3. The evaporated fuel treatment apparatus according to claim 1, wherein an end surface of the first filter on the tank port side is formed to be inclined so that a lower end of the end surface is located closer to the tank port than an upper end thereof.

4. The evaporated fuel treatment apparatus according to claim 1, wherein a restriction portion in which an opening area per unit area of an upper portion is larger than that of a lower portion is provided on the first filter on the tank port side.

5. The evaporated fuel treatment apparatus according to claim 1, wherein a second filter is provided to be inclined at an end of the adsorption chamber, located closest to said atmosphere port, on the atmosphere port side so that a lower end of the second filter is located closer to the tank port than an upper end thereof.

6. The evaporated fuel treatment apparatus according to claim 1, wherein a thickness of the first filter is made to be thinner in stages from the lower end to the upper end thereof.

* * * * *